US008172636B1

(12) United States Patent
Carbonero

(10) Patent No.: US 8,172,636 B1
(45) Date of Patent: May 8, 2012

(54) PLAYGROUND HOOP-HOLDING APPARATUS

(75) Inventor: Kurt K. Carbonero, Mount Pleasant, SC (US)

(73) Assignee: Pull-Buoy, Inc., Sterling Heights, MI (US)

( * ) Notice: Subject to any disclaimer, the term of this patent is extended or adjusted under 35 U.S.C. 154(b) by 1148 days.

(21) Appl. No.: 11/522,072

(22) Filed: Sep. 15, 2006

(51) Int. Cl.
*A63H 33/06* (2006.01)

(52) U.S. Cl. ..... 446/120; 446/125

(58) Field of Classification Search ..... 446/120, 446/101, 104, 114, 121, 124–126
See application file for complete search history.

(56) References Cited

U.S. PATENT DOCUMENTS

| | | | | | |
|---|---|---|---|---|---|
| 1,647,679 | A | * | 11/1927 | Williams | 220/9.2 |
| 3,115,340 | A | | 12/1963 | Stasiuk | |
| 3,392,480 | A | | 7/1968 | Stubbmann | |
| 4,352,255 | A | | 10/1982 | Warehime | |
| 4,440,519 | A | | 4/1984 | Pennel et al. | |
| 4,548,590 | A | | 10/1985 | Green | |
| 4,852,881 | A | * | 8/1989 | Bellagamba et al. | 473/216 |
| 5,042,769 | A | | 8/1991 | Smed | |
| D336,121 | S | * | 6/1993 | Bellagamba | D21/791 |
| 5,393,163 | A | | 2/1995 | Wolf | |
| D375,774 | S | * | 11/1996 | Harrold | D21/791 |
| 5,800,067 | A | * | 9/1998 | Easter | 383/104 |
| D410,705 | S | | 6/1999 | Toft | |
| 6,273,826 | B1 | * | 8/2001 | Bauer | 473/219 |
| 6,308,840 | B1 | * | 10/2001 | Mulholland et al. | 211/70.2 |
| 2005/0197197 | A1 | * | 9/2005 | Scott | 473/173 |

FOREIGN PATENT DOCUMENTS

| | | |
|---|---|---|
| GB | 508 002 | 6/1939 |

* cited by examiner

*Primary Examiner* — Nini Legesse
(74) *Attorney, Agent, or Firm* — Honigman Miller Schwartz and Cohn LLP

(57) ABSTRACT

A toy-holding apparatus for securely holding at least two playground toys, such as hoops or wands, in a predetermined relationship to one another includes a first hoop grip adapted to releasably grip a first playground hoop and a second hoop grip adapted to releasably grip a second playground hoop. A connecting element is disposed between the first and second hoop grips. A friction-inducing insert is disposed on at least one of the hoop grips to minimize unintended movement between the hoop grips and the hoops.

6 Claims, 5 Drawing Sheets

PLAYGROUND HOOP-HOLDING APPARATUS

TECHNICAL FIELD

The present invention generally relates to physical education equipment and more specifically to hoop-holding devices for securely holding at least two playground hoops in a predetermined relationship to one another.

BACKGROUND

People skilled with gym equipment and sporting goods are familiar with playground hoops and their use for recreational and physical education purposes. Playground hoops are commonly used for exercise or recreation. These hoops can also be placed on the ground in various positions to facilitate different playground games. The playground hoops provide circular spaces on the floor, forming the basis for many playground games. But used alone, these hoops may only be used in a position parallel with the ground unless someone holds the hoop in an upright position.

The user's hoop-positioning options are limited by the horizontal hoop-orientation, and to have someone hold the hoop is impractical. Additionally, common playground hoops are usually fashioned from hard plastic. Firmly linking hoops and hoop-holding devices, both made from hard plastic, is difficult because of hard plastic's low coefficient of friction. Even with small tolerances between the playground hoop and hoop-holding device, the slightest disturbance will move the hoop relative to the hoop-holding device.

Standard commercial playground hoops have diameters that range from approximately ⅝" to ⅞". Achieving a reasonable fit between a hoop-holding device and various playground hoop diameters in the past required the hoop-holding device diameter to be matched with the diameter of the particular hoop being held. Users of playground hoops often include school gym teachers who constantly replace broken or damaged hoops. Finding cheap replacement hoops is difficult because one must find the exact hoop diameter of the hoop holder. Purchasing multiple hoop-holding devices for each hoop diameter would allow owners to purchase a greater variety of hoop sizes. But this solution is expensive and impractical, requiring extra money to purchase additional hoop-holding devices, extra time to coordinate appropriately sized hoops and hoop-holders and extra storage space for housing the equipment.

The prior art addresses the aforementioned problems by gripping the hoops with c-clips. These c-clips are generally spaced either by a straight bar or an angled joint. The straight bar, angled joint and c-clip components are united using pressure-fit components and are subject to unintentional separation if bumped or nudged during rough play. Further, the prior-art designs attach two hoops, but force the user to keep the hoops in a horizontal position on the ground, link the hoops in a square lattice or precariously position an upright hoop at an angle ninety degrees to the ground. If the hoop is positioned at an angle less than ninety degrees to the ground, gravity, acting in concert with the weight of the hoop, will force the hoop to fall. Even with the hoop standing perpendicular to the ground, small disruptions will cause the hoop to move or fall. It is possible to place the hoops at different angles using the prior art. But the hoops will fall very easily due to the smooth surfaces of previous hoop-holding solutions and the weight of the hoop. Without a robust hoop-holding attachment having the ability to accommodate multiple cross-sectional hoop diameters, the uses for hoop-holding devices are quite limited.

SUMMARY OF THE INVENTION AND ADVANTAGES

According to one conception of the invention, a toy-holding apparatus for securely holding at least two playground toys, such as hoops or wands, in a predetermined relationship to one another includes a first hoop grip adapted to releasably grip a first playground hoop and a second hoop grip adapted to releasably grip a second playground hoop. A connecting element is disposed between the first and second hoop grips. A friction-inducing insert is disposed on at least one of the hoop grips to minimize unintended movement between the hoop grips and the hoops.

According to another conception of the invention, a hoop-holding assembly for holding at least two hoops in a predetermined configuration for physical education purposes includes a first c-clip adapted to hold a first hoop and a spaced apart second c-clip adapted to hold a second hoop. Each c-clip includes a hoop-gripping surface. Disposed between the first and second c-clips is a link interconnecting the c-clips. A frictional surface is disposed on the hoop-gripping surface of each c-clip to prevent unwanted relative movement between the hoops and the c-clips.

A third concept of the invention is a method for holding a playground hoop in a predetermined temporary orientation with a device having at least one gripping element having a friction-inducing element disposed thereon. The method includes inserting the hoop into the gripping element, causing the gripping element to deflect a predetermined amount to receive the hoop and deforming the friction-inducing element a predetermined amount to firmly grip the hoop until it is removed.

This new arrangement provides a hoop holding device that holds hoops securely in the face of physical play. The secure hoop grip permits hoops to be positioned in multiple configurations. They can be set up as horizontal or vertical targets for playground balls, as hoops children jump through, or any other user-desired creation. The arrangement also allows quick and easy readjustment of the hoop-holding position without disassembly. The novel hoop-holding device is light, compact, inexpensive and requires few parts which stay together during physical education class use. Moreover, the device permits securely holding hoops that might have a variety of sizes.

DESCRIPTION OF THE PREFERRED EMBODIMENT

Figure 1:
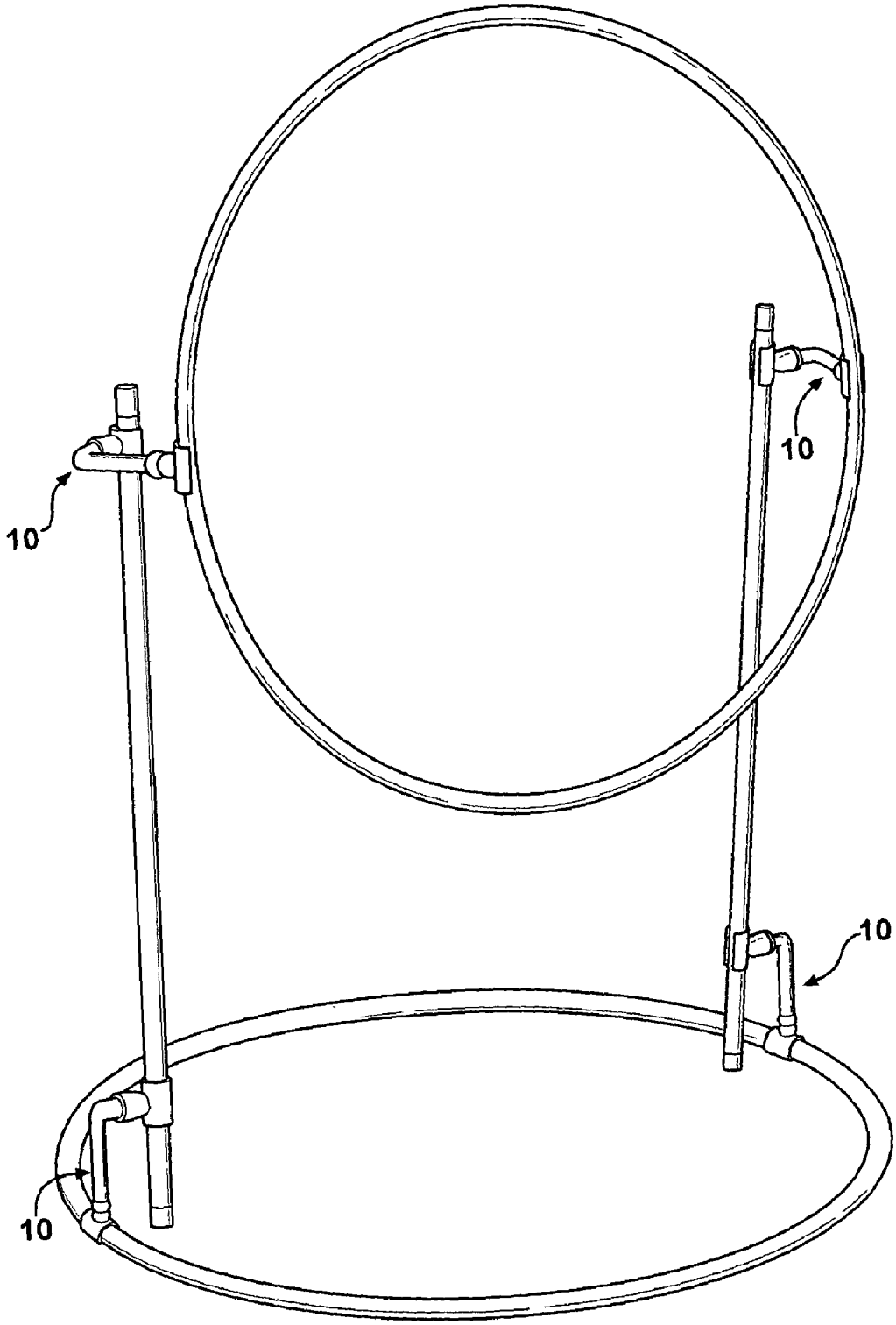
FIG. 1 shows the inventive hoop-holding apparatus in its intended environment, where several hoop-holders combine with several playground hoops and wands to create a desired construction.
Figure 2:
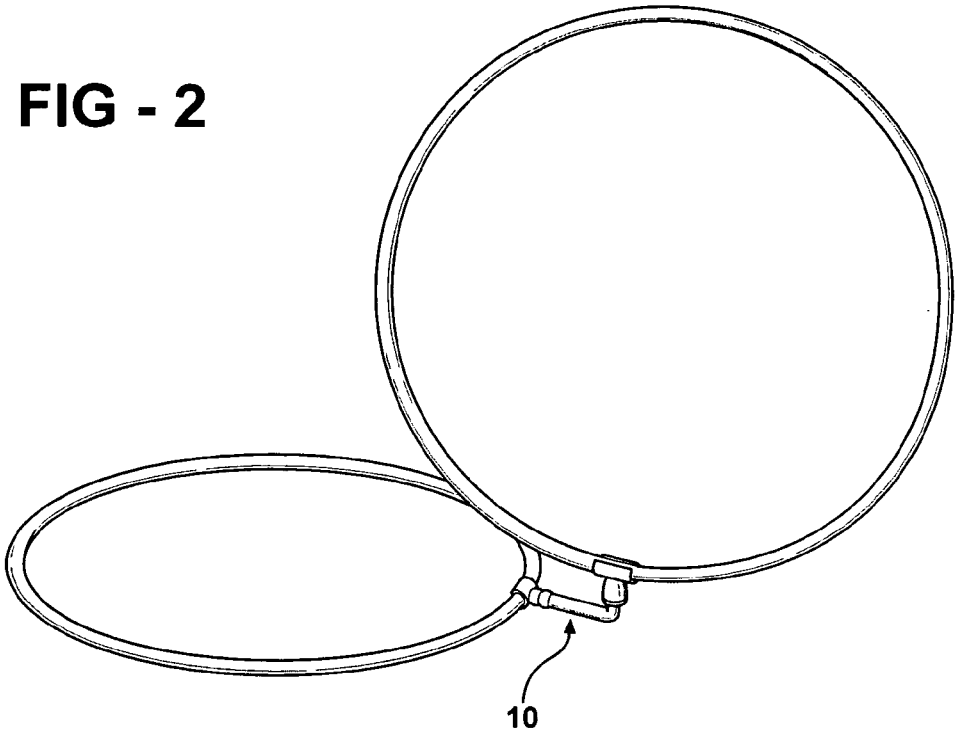
FIG. 2 shows a perspective view of a single hoop-holding apparatus in an alternative configuration using only hoops.
Figure 3:
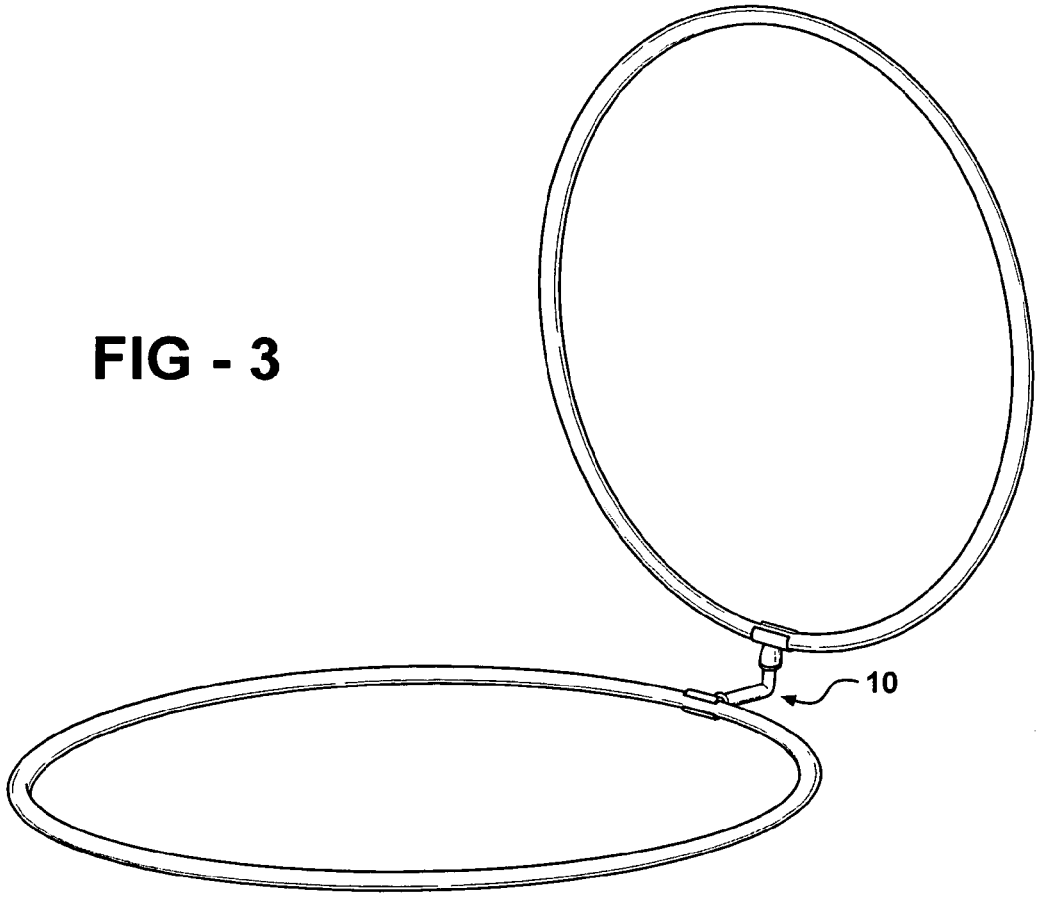
FIG. 3 shows an additional perspective view of a single hoop-holding apparatus in an alternative configuration using only hoops.
Figure 4:
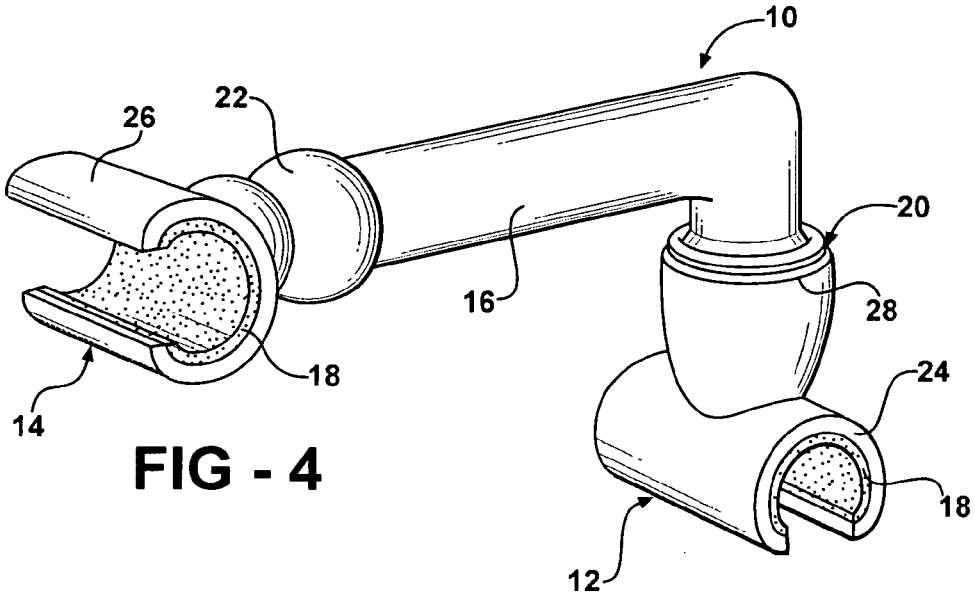
FIG. 4 shows a perspective view of a single hoop-holding apparatus.
Figure 5:
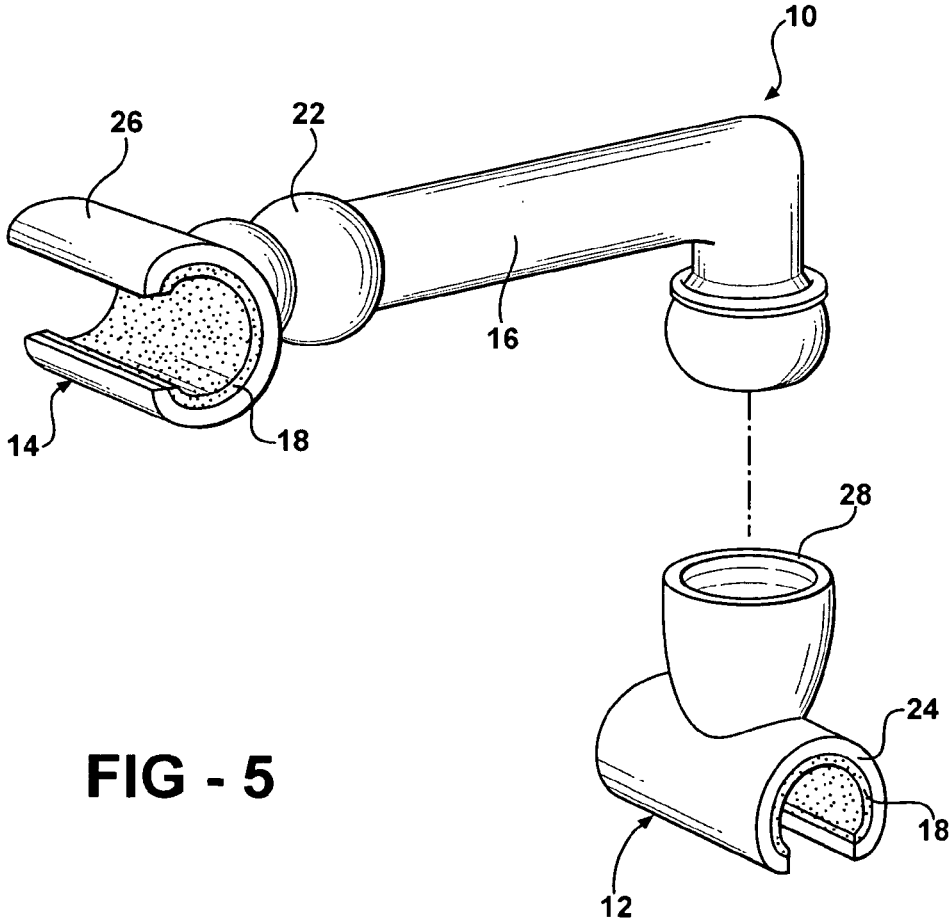
FIG. 5 shows an exploded view of a hoop-holding apparatus.
Figure 6:
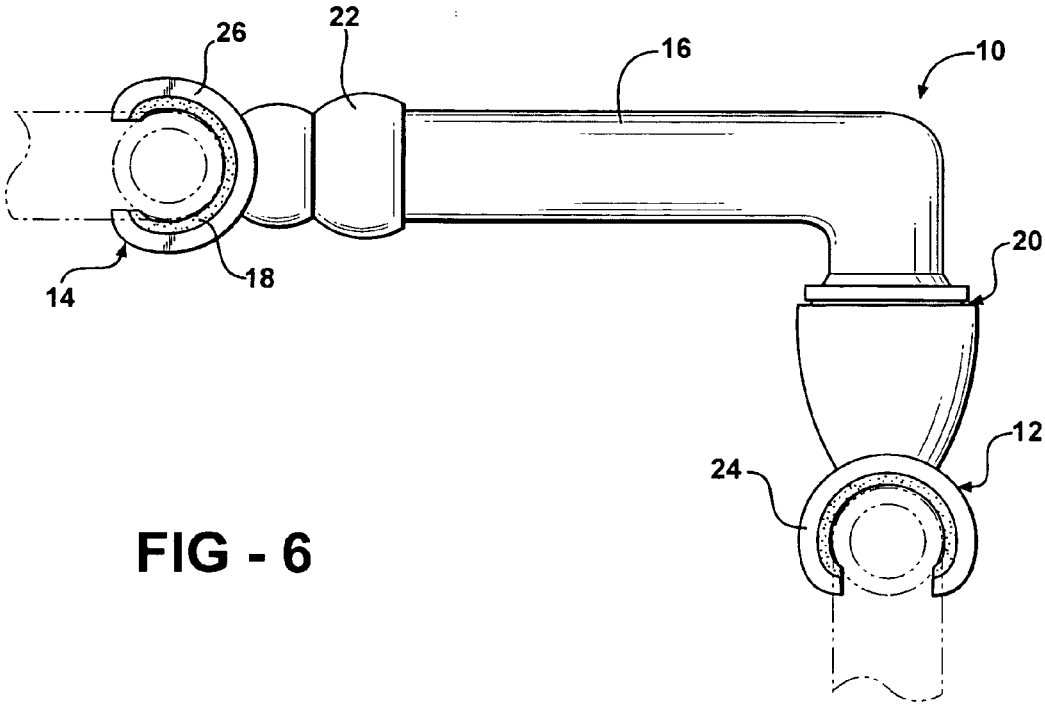
FIG. 6 shows a side view of a hoop-holding apparatus gripping playground hoops that are shown in phantom.
Figure 7:
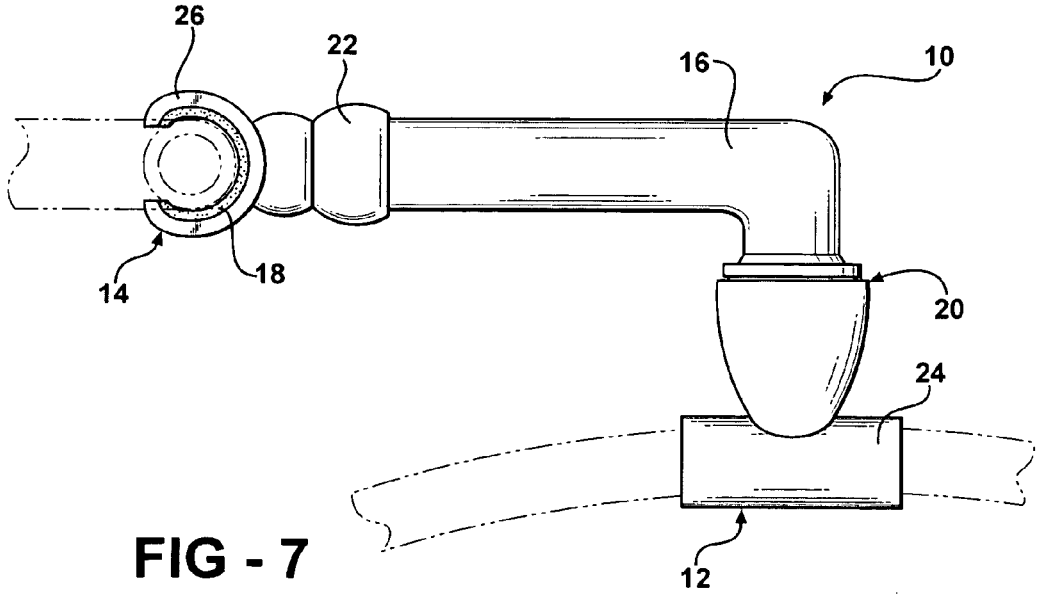
FIG. 7 shows a side view of an alternate configuration of the hoop-holding apparatus while gripping playground hoops that are shown in phantom.
Figure 8:
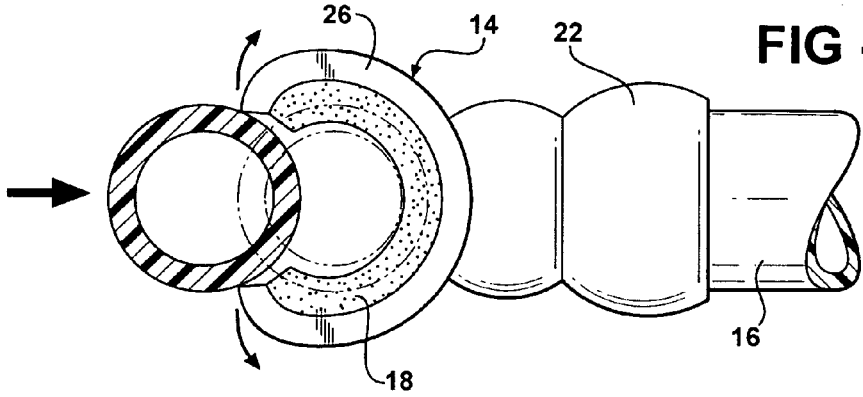
FIG. 8 shows a side view of the insertion of a large-diameter playground hoop into a hoop-grip.

According to the most basic concept of the invention, a hoop-holding apparatus generally shown at 10 consists of a first hoop grip generally indicated at 12 adapted for releasably gripping a first playground hoop, and a second hoop grip generally indicated at 14 adapted for releasably gripping a second playground hoop. Disposed between the first and second hoop grips (12 and 14) is a connecting element 16 interconnecting the grips.

The first hoop grip 12 comprises several subparts including a friction-inducing insert 18, a first c-clip 24 and a first hoop grip end piece 28. The first c-clip 24 is c-shaped in the embodiment that is illustrated, but the cross-sectional shape could be modified to similar forms by those skilled in the art. The first hoop-grip end piece 28 is a circular socket and fits with the connecting element 16 forming a rotatable joint 20. The first c-clip 24 has a c-shaped design allowing playground hoops to attach to and release from the hoop-holding apparatus 10. Further, the inside diameter of the first c-clip 24 combined with the friction-inducing insert 18 is smaller in diameter than the outside diameter of a playground hoop. This design results in a snug fit between the first c-clip 24 and a playground hoop, placing a hoop in a fixed, user defined position. The snug fit firmly holds the hoops steady against unwanted deflection. The first hoop grip 12, the first c-clip 24 and the first hoop-grip end piece 28 are generally composed of ABS plastic or another similar material. ABS plastic provides an acceptable amount of deflection of the first c-clip 24 for inserting hoops while also providing an adequate amount of griping force on the hoop. ABS plastic also gives the first c-clip 24 a memory characteristic that returns it to its original shape after deflection.

The second hoop grip 14 comprises several subparts including a friction-inducing insert 18, a second c-clip 26 and a fixed joint 22. Like the first c-clip 24, the second c-clip 26 is c-shaped, but the cross-sectional shape could be modified to similar forms by those skilled in the art. The fixed joint 22 connects the second c-clip 26 and the connecting element 16 holding each in a rigid position. Again, the inside diameter of the second c-clip 26 combined with the friction-inducing insert 18 is smaller in diameter than the outside diameter of a playground hoop. This design results in a snug fit between the second c-clip 26 and a playground hoop, placing a hoop in a fixed, user defined position. The snug fit firmly holds the hoops steady against unwanted deflection. The second hoop grip 14, the second c-clip 26 and the fixed joint 22 are generally composed of ABS plastic or another similar material. ABS plastic provides an acceptable amount of deflection of the second c-clip 26 for inserting hoops while also providing an adequate amount of griping force on the hoop. Similar to the first c-clip, ABS plastic also gives the second c-clip 26 a memory characteristic that returns it to its original shape after deflection.

The playground hoops are hula hoops or other common playground toy hoops having cross-sectional diameters of approximately ⅝" to ⅞" in. In addition to playground hoops, wands can also be used with the hoop-holding device. Wands are generally straight and tubular having a cross-sectional diameter similar to that of playground hoops. They can be constructed from any suitable material such as wood, plastic or metal, and can be made into various lengths. Hoops may be used by themselves; Wands may be used by themselves or in conjunction with hoops with the hoop-holding apparatus 10.

The rigid connecting element 16 may be a link or an L-shaped link. The connecting element 16 is tubular, but can be various cross-sectional shapes. Both the connecting element 16 and the first and second hoop grips (12 and 14) are generally composed of ABS plastic or another similar material.

Disposed on the first and second hoop-grips (12 and 14) is a friction-inducing insert 18. The friction-inducing insert 18 may also be conceived of as a frictional surface or a friction-inducing layer. The friction-inducing insert 18 attaches to the hoop-holding side of both the first and second c-clips (24 and 26). The friction-inducing insert 18 can be made from thermoplastic rubber. One potential thermoplastic rubber is T-BLEND™ 6800 N-AB-X. T-BLEND™ is a compounded thermoplastic material composed primarily of SBS or SEBS commercially available from the Taiwan Synthetic Rubber Corporation located at 18F, 95 Dun Hua S. Road, Sec. 2, Taipei, 106 Taiwan, R.O.C. It has the following components:

| Components | CAS No. | Percent |
|---|---|---|
| T-BLEND 6800 N-AB-X | — | 100 |
| Hydrogenated Styrene-Butadiene block copolymer | 66070-58-4 | >25 |
| Polypropolene | 9003-07-0 | >10 |
| Polyester | — | >45 |
| Processing oil | 64742-54-7 | <15 |
| Fillers | 471-34-1 | >5 |
| Antioxidants and Stabilizers. | 2082-79-3 | <1 |

It is recyclable and weather resistant. Its hardness can be adjusted, and it is tolerant to a broad range of chemicals. This T-BLENDT™ material is one example, but many others are possible. A non-exhaustive list of possible materials includes neoprene, silicone, synthetic rubber, natural rubber, elastomeric material, thermoplastic elastomer thermosets, synthetic resin or even a sandpaper-type abrasive material.

The material chosen will provide a durable and compressible source of friction. Regardless of the material, the friction-inducing insert 18 may take on various shapes, sizes and thicknesses. A desirable design includes a solid sleeve that completely covers the first or second c-clip (24 or 26). Many other suitable possibilities include but are not limited to ribs, dots, thin film or tape, fins or slats. The desired shape and material is affixed using a permanent adhesive or other permanent attachment. One possible embodiment has an ABS c-clip with wall thickness of 3.4 mm and inside diameter of 24.6 mm in combination with a T-BLEND insert having a thickness of 2.1 mm. These two parts together result in a c-clip inside diameter of 20 mm including the T-BLEND insert.

Positioned between the first hoop-grip 12 and the connecting element 16 is a rotatable joint generally indicated at 20. The rotatable joint allows the user to rotate the first hoop-grip 12 up to 360 degrees. Additionally, the first hoop-grip 12 and the connecting element 16 can be separated at the rotatable joint 20. A first hoop-grip end 28 opposite the friction-inducing element 18 attaches to the connecting element 16 forming the rotatable joint 20. This attachment results in a tight fit requiring a substantial amount of force to rotate the first hoop-grip 12. The rotatable joint 20 is composed of ABS plastic or another similar material.

According to another concept of the invention, a method for holding a playground hoop with a device having a gripping element and a friction-inducing element disposed thereon includes inserting the hoop into the gripping element, causing the gripping element to deflect a predetermined amount to receive the hoop and deforming the friction-inducing element a predetermined amount. An example of a gripping element could be the hoop grips (12 and 14) as described previously or any other suitable means for gripping playground hoops. The friction-inducing element could also be a friction-inducing insert 18 or any other material that could create friction.

In operation, the user forcibly pushes the playground hoops into the hoop-grips (12 and 14), deflecting the first and second c-clips' (24 and 26) into an expanded configuration. Upon the playground hoops' surface making full contact with the friction-inducing inserts 18, the inserts compress with pressure from the c-clips' (24 and 26) c-shaped structure, effectively holding the playground hoops rigidly in place. To release the hoop-grips (12 and 14), the user applies force on the playground hoops in an opposite direction from the hoop-grips (12 and 14). The c-shaped structure of the first and second c-clips (24 and 26) flexes, creating a hoop-grip diameter larger than the outer diameter of the playground hoop, allowing the hoop grips (12 and 14) to release the playground hoops.

Figure 9:
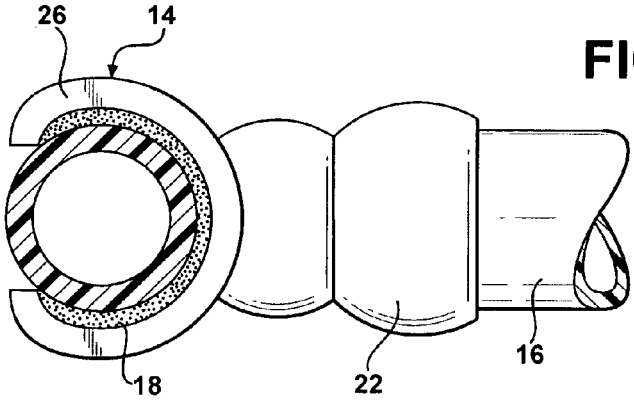
FIG. 9 shows a side view of the hoop-grip holding a large-diameter playground hoop.
Figure 10:
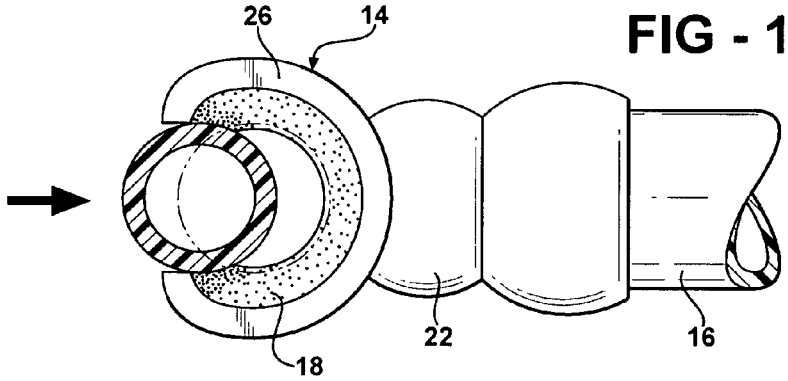
FIG. 10 shows a side view of the insertion of a small-diameter playground hoop into a hoop-grip.
Figure 11:
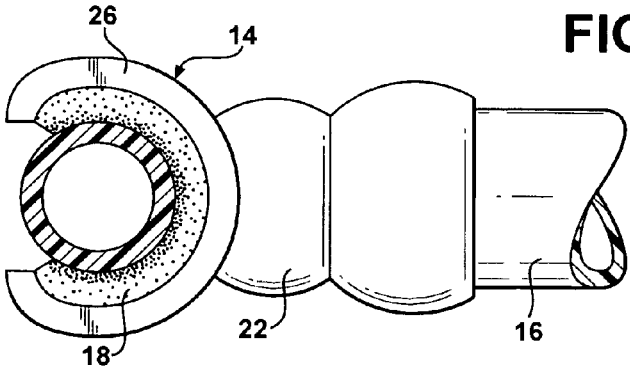
FIG. 11 shows a side view of the hoop-grip holding a small-diameter playground hoop.

Referring to FIGS. 8-11, the friction-inducing insert 18 compresses when acted on by the first and second c-clips (24 and 26) and engaged with a hoop, providing the resistance and close fit necessary for fixing a hoop in a user-defined position. More specifically, the first and second c-clips (24 and 26) can firmly and robustly grip hoops with relatively large cross-sectional sizes. In one embodiment shown in FIG. 8, a relatively large cross-sectional diameter playground hoop will force the c-clip walls to move away from each other in order to accommodate the hoop. Together with the c-clip walls moving outward, the hoop will put greater pressure on the friction-inducing insert 18 causing it to compress more fully as shown in FIG. 9. Conversely, the first and second c-clips (24 and 26) can also firmly and robustly grip hoops with relatively small cross-sectional sizes. As shown in FIG. 10, when a small-diameter hoop is inserted into the hoop-grip, the friction-inducing insert 18 compresses less than when a large-diameter hoop is inserted. Also, the c-clip walls deflect less than when a large-diameter hoop is inserted. But it still compresses; and even with less compression from the friction-inducing insert 18 and less deflection from the c-clip walls, the first and second c-clips (24 and 26) still firmly and robustly grip small-diameter hoops as seen in FIG. 11. FIGS. 8-11 show the second c-clip 26, but the above described effect also applies to the first c-clip 24. Additionally, after the hoop is released from a hoop grip, the friction-inducing insert material's memory characteristic gives it the ability to return to its original shape and state.

Obviously, many modifications and variations of the present invention are possible in light of the above teachings. Therefore, it is to be understood that within the scope of the appended claims the invention may be practiced otherwise than as specifically described.

I claim:

1. A method for holding at least two playground hoops in a predetermined temporary orientation with a device having at least two gripping elements each having a friction-inducing element disposed thereon including:

inserting the hoops into the gripping elements;

causing the gripping elements to deflect a predetermined amount to receive the hoops;

deforming the friction-inducing elements a predetermined amount to prevent unintended rotational movement between the hoops;

aligning the hoops into the predetermined orientation; and holding the hoops in the predetermined orientation until they are removed.

2. A method as claimed in claim 1 wherein the gripping element is comprised of a material that returns to its original form after deflection.

3. A method as claimed in claim 1 wherein the friction-inducing element is comprised of a material that returns to its original form after compression.

4. A method as claimed in claim 1 wherein the deflection of the gripping element and compression of the friction-inducing element work in concert to firmly grip at least one playground hoop.

5. A method as claimed in claim 1 wherein the deflection of the gripping element and the compression of the friction-inducing element work in concert to firmly grip at least one wand.

6. The method of claim 1 including using a wand in the place of a hoop.

* * * * *